US006390066B1

(12) United States Patent
Drummer et al.

(10) Patent No.: US 6,390,066 B1
(45) Date of Patent: May 21, 2002

(54) FUEL INJECTION SYSTEM FOR AN INTERNAL COMBUSTION ENGINE

(75) Inventors: Eugen Drummer, Steyr; Christian Ganser, Linz, both of (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/623,430

(22) PCT Filed: Nov. 30, 1999

(86) PCT No.: PCT/DE99/03783

§ 371 Date: Nov. 3, 1999

§ 102(e) Date: Nov. 3, 1999

(87) PCT Pub. No.: WO00/40854

PCT Pub. Date: Jul. 13, 2000

(30) Foreign Application Priority Data

Jan. 2, 1999 (DE) ..... 199 00 033

(51) Int. Cl.[7] ..... F02M 41/00
(52) U.S. Cl. ..... 123/467; 239/96
(58) Field of Search ..... 123/467, 446, 123/447, 500, 501, 503; 239/96

(56) References Cited

U.S. PATENT DOCUMENTS 3,640,466 A * 2/1972 Steiger ..... 239/94
4,333,436 A * 6/1982 Kopse et al. ..... 123/502
5,357,933 A * 10/1994 Kasahara et al. ..... 123/506
5,441,029 A * 8/1995 Hlousek ..... 123/467
5,893,350 A * 4/1999 Timms ..... 123/467

FOREIGN PATENT DOCUMENTS

DE 4406901 * 9/1995

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

A fuel injection system for internal combustion engines in which the control of the fuel injection valve member is controlled by controlling the pressure of a control chamber. The control chamber is either relieved by a 3/2-way control valve or made to communicate with a high-pressure fuel source. The control valve is designed such that the control valve has a valve body, which on both sides carries a valve sealing face, which cooperate with a first valve seat and second valve seat, respectively, and control the inflow of high pressure into or outflow thereof out of the control chamber. To vary the dynamics of the control events, the valve body, upstream of the second valve sealing face, has a throttle gap, and downstream of the first valve sealing face the valve body has a collar, between the collar and the throttle gap a pressure conduit leads away to the control valve, the inflow and outflow to and from which is thus varied.

2 Claims, 1 Drawing Sheet

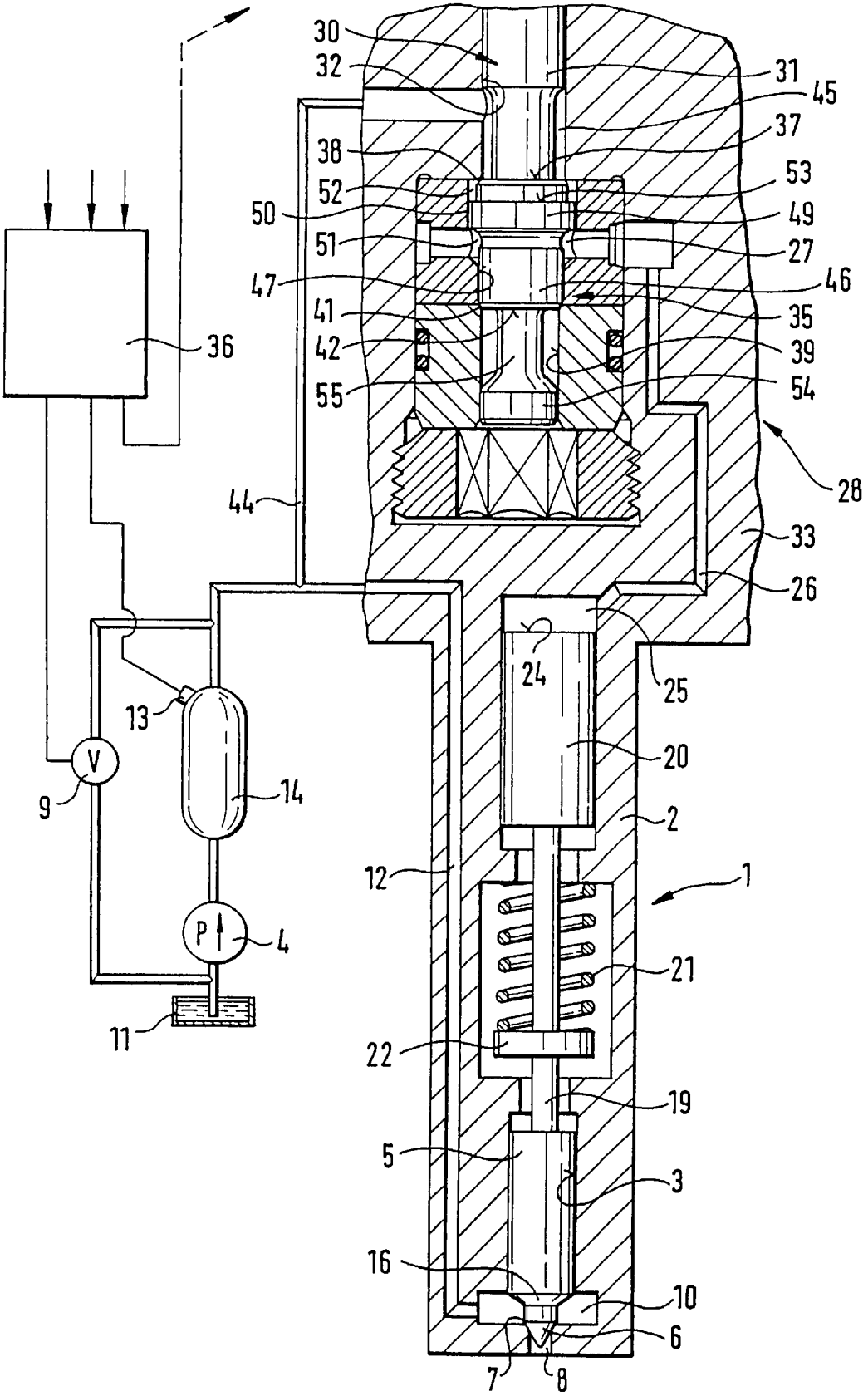
30
32
31
45
37
38
53
52
50
49
51
27
47
46
41
35
42
39
55
54
36
28
44
33
26
24
25
13
20
V
9
14
2
12
1
P
4
21
11
22
19
5
3
16
10
6
7
8

FUEL INJECTION SYSTEM FOR AN INTERNAL COMBUSTION ENGINE

PRIOR ART

The invention is based on a fuel injection system for internal combustion engine. In one such fuel injection system, known from German Patent Application DE-A 44 06 901, the electromagnetically driven 3/2-way control valve that electromagnetically controls the pressure in the control chamber is designed such that in one position, the control valve connects the valve chamber with the high-pressure fuel source, which then also communicates with the control chamber at the same time, and in another position connects the valve chamber and at the same time the control chamber with the relief chamber. A throttle is formed downstream of the valve seat in the control valve in the outflow conduit through which the relief speed and consequently the opening rate of the fuel injection valve member can be reduced at the injection onset. On the inlet side to the control chamber, conversely, no flow limitation is provided, so that the end of the fuel injection event can be effected rapidly by means of a rapid pressure buildup in the control chamber that puts the fuel injection valve member into the closing position. This arrangement has the disadvantage that the outflowing fuel, by the diversion process of which the fuel injection onset is intended to be initiated, is throttled downstream of the valve seat, which leads to a pressure buildup upstream of the throttle. If the diversion occurs suddenly, the result is feedback forces on the control valve member, which adversely affect the switching times of the control valve because they counteract the controlling motion of the valve member. The final outcome is that injection quantities in successive injection events vary considerably.

ADVANTAGES OF THE INVENTION

With the fuel injection system according to the invention hydraulic surges that occur as pressure fluid and is diverted from the control chamber to the control valve member have hardly any effect on the uniformity of the injection events. Disruptive feedback is averted by the throttle located upstream of the valve seat. It is advantageous that the throttle is realized on the valve body without requiring any additional component or additional machining steps. In an advantageous refinement, an additional damping of the hydraulic surges on the valve body is effected. The collar has the effect that the quantity of pressure fluid flowing into the valve chamber, which quantity is meant to be delivered for control purposes to the control chamber, is throttled downstream of the valve seat and by a pressure buildup, an additional force on the valve body in the opening direction thereof is created. Thus, the pressure required to terminate the injection can be built up more rapidly in the control chamber. The result is accordingly faster switching times of the control valve. When the second valve seat opens, in the process of which the valve body moves in the closing direction to the first valve seat, a delay upon closure of the valve seat occurs because of the presence of the collar, and thus a delay in the relief of the control chamber and a corresponding desired delay, already sought by the throttle, in the pressure rise at the injection valve member.

Further advantages of the invention can be learned from the ensuing description in conjunction with the drawing.

The FIGURE illustrates a fuel system in combination with a cross sectional view of a control valve.

DESCRIPTION OF THE EXEMPLARY EMBODIMENT

FIG. 1 is a simplified illustration of a fuel injection valve 1, which has an injection valve housing 2 with a bore 3 in which an injection valve member 5 is guided. On one end, the injection valve member has a conical sealing face 6, which cooperates with a conical valve seat 7 on the end of the bore. Downstream of the valve seat 7, there is at least one fuel injection opening 8, which when the sealing face 6 is mounted on the valve seat 7 is disconnected from a pressure chamber 10. The pressure chamber 10 can be made to communicate via a pressure line 12 with a high-pressure fuel source in the form of a high-pressure fuel reservoir 14, which is supplied with fuel, brought to injection pressure, from a tank 11, for instance by a high-pressure pump 4 that feeds at a variable feed rate. The pressure in the high-pressure fuel reservoir can, however, also be controlled by means of a pressure control valve 9 as a function of the signal of a pressure sensor 13, by the diversion of a fuel quantity required for maintaining the pressure. In the region of the pressure chamber 10, the injection valve member has a pressure shoulder 16, pointing toward the valve seat 7, upon which shoulder the high fuel injection pressure prevailing in the pressure chamber 10 acts on the injection valve member 5 in the opening direction. On the side of the injection valve member remote from the pressure shoulder 16, the injection valve member continues in the form of a connecting part 19 extending as far as a spool-shaped end 20 of the injection valve member. In the region of the connecting part, the injection valve member has a spring plate 22, between the spring plate and the housing 1 of the fuel injection valve, a compression spring 21 is fastened that urges the fuel injection valve member into the closing position.

The spool-like end 20, with a face end 24 that forms a movable wall and has an area larger than that of the pressure shoulder 16, defines a control chamber 25 in the housing 2 of the fuel injection valve, from the control chamber a pressure conduit 26 leads away into a valve chamber 27 of a control valve 28.

The control valve 28 is embodied as a 3/2-way valve and has a control valve member 30, with a valve tappet 31 that is guided in a tappet guide bore 32 in the housing 33 of the control valve 28 and protrudes with one end into the valve chamber 27. There, the tappet has a valve body 35, which on its side toward the tappet guide bore 32 has a first valve sealing face 37. The first valve sealing face cooperates with a first valve seat 38 that is formed at the transition from the tappet guide bore to the valve chamber 27. Opposite the entrance of the tappet guide bore 32 into the valve chamber 27, an outflow conduit 39 communicating with a relief chamber leads away from the valve chamber 27; an exit from the valve chamber 27 is embodied as a second valve seat 41 of the control valve, with the seat a second valve sealing face 42 of the valve body 35 cooperates. The control valve member is actuated by an actuator which is controlled by a control device 36 and is not shown here, such as an electromagnet or a piezoelectric drive means, which can also be designed in step-up fashion, and in the process moves with its valve body back and forth between the first and the second valve seat. The control device controls the pressure in the high-pressure fuel reservoir 14 with the aid of a pressure detector, such as the pressure sensor 13. The tappet guide bore 32 acts as an inflow conduit, in that the valve tappet 31, adjacent to the first valve sealing face 37, and together with the wall of the tappet guide bore 32 forms a recess 45 in the form of an annular chamber, into which an inflow conduit 44 discharges that communicates continuously with the high-pressure fuel reservoir.

In the region between the two valve seats 38, 41, the pressure conduit 26 leads away from the valve chamber 27 to the control chamber 25.

The second valve sealing face 42 is provided on the face end of a cylindrical spool part 46, which has a cylindrical jacket face that together with a cylindrical wall of the valve chamber forms an annular throttle gap 47, by which a throttle is thus formed upstream of the second valve seat 41; this throttle controls the rate of fuel outflow from the control chamber 25 via the valve chamber 27 to the outflow conduit 39 or the relief chamber. If the control valve member is opened by the electromagnet, then the fuel can then escape only in throttled fashion. Since the throttling takes place downstream of the valve seat, however, pressure surges have little effect on the motion of the valve body 35, since in contrast to the situation on its end toward the outflow conduit, the valve body is force-balanced inside the valve chamber 27.

The valve body 35 also has a cylindrical collar 49, spaced apart from the first valve sealing face 37 toward the valve chamber 27. The collar together with the wall of the valve chamber adjoining the circumference of the collar forms an annular gap 50, which between itself and the cylindrical spool part 46 forms an annular chamber 51. The pressure line 26 branches off from the annular chamber to connect the valve chamber 27 to the control chamber 25. When the first valve sealing face 37 is in contact with the first valve seat 38, a valve pressure chamber 52 is enclosed between the collar 49 and the first valve seat 38. The pressure of this pressure chamber acts on a shoulder 53 of the collar 49 in such a way that as soon as the first valve sealing face 37 lifts away from the first valve seat 38, high-pressure fuel from the inflow conduit 44 flows into the valve chamber 27 and a force component acts on the collar 49 and thus on the control valve member 30, and the force component seeks to reinforce the above-described opening motion. The pressure buildup in the control chamber 25 and at the same time the termination of the injection event by the injection valve thus proceed faster. In this event, the second valve sealing face 42 is at the same time brought into contact with the second valve seat 41, and the outflow conduit 39 is closed.

In the opposite case, that is, if the pressure in the control chamber 25 is to be decreased, in order to trip the injection, the valve body 35 moves in the opposite direction from what is described above. The fuel flows in throttled fashion out through the throttle 47 at the second valve seat 41, and the switching motion of the valve body counteracts the pressure in the valve pressure chamber 52, which leads to a delay in the switching motion of the control valve member 30. This is desirable, because for the sake of noise and emissions, the onset of injection should occur slowly. Since in this exertion of force on the valve body 35 the pressure in the annular chamber 51 between the collar 49 and the cylindrical spool part 46 is also operative, the gap width of the annular gap 50 of the collar 49 from the wall of the valve chamber 27 and the width of the throttle gap on the cylindrical spool part must be adapted to one another. The valve seats 38, 41 and the valve sealing faces 37, 42 are advantageously embodied conically. The tappet guide bore 32 and the outflow conduit 39 continue to be located coaxially to one another as shown in the drawing.

The cylindrical spool part 46 is adjoined, via a connecting part 55 of reduced diameter, by a compensation spool 54, which dips into the outflow conduit 39 and toward the wall thereof forms a gap of substantially greater width than the width formed at the throttle gap 47.

Because the tappet guide bore 32, on its end that has the first valve seat 38 or as a result of the end face that forms when the first valve sealing face 37 is seated on the first valve seat 38, is larger toward the valve chamber 27 inside the recess 45 than the boundary area toward the tappet of the recess 45, the control valve member 30 can be slightly prestressed in the direction of the valve chamber 27 by the pressure in the inflow conduit 44. This force acting in the direction of opening the valve formed by the first valve seat 38 and the first valve sealing face 37 cooperates with a compression spring, not shown here, of the actuator and at the same time acts in the direction of closure of the valve at the outflow conduit 39 formed by the second valve seat 41 and the second valve sealing face 42. This is especially favorable in the case of an electromagnetic actuator, which is without current in this switching position.

The foregoing relates to a preferred exemplary embodiment of the invention, it being understood that other variants and embodiments thereof are possible within the spirit and scope of the invention, the latter being defined by the appended claims.

We claim:

1. A fuel injection system for internal combustion engines, comprising a high-pressure fuel source (14), a fuel-injection valve (1) is supplied with fuel from said fuel source (14), said fuels injection valve includes an injection valve member (5) which is opened under a pressure of a fuel delivered from said fuel source, the fuel communicates at least indirectly with a movable wall (24) that defines a control chamber (25) which receives fuel from a pressure conduit (26), the pressure conduit (26) communicates continuously with a valve chamber (27) of a control valve (28), the control valve (28) includes a control valve member (30) which communicates with an inflow conduit (44) and controls fuel flow to the valve chamber (27) coming from the high-pressure source, the valve chamber (27) communicates with an outflow conduit (39) that leads to a relief chamber, a valve tappet (31) controls the control valve member (30) and the control valve member (30) has a valve body (35) that protrudes into the valve chamber (27), the valve control member (30) is provided on a first side with a first valve sealing face (37) and on a second side with a second valve sealing face (42), each valve sealing face pointing in one of the directions of actuation of the valve tappet, so that, depending on the position of the valve body, the first valve sealing face (37) can come into contact with a first valve seat (38), whereupon the communication of the inflow conduit (44) with the valve chamber (27) is closed, and alternatively the second valve sealing face (42) can come into contact with the second valve seat (41), whereupon the communication between the valve chamber (27) and the outflow conduit (39.) is closed, a throttle (47) is provided in a communication between the valve chamber (27) and the outflow conduit (39), the first valve seat (38) being formed at the orifice of a tappet guide bore (32) that guides the valve tappet (31) in the valve chamber (27), and a portion of the valve tappet (31) located upstream of the first valve sealing face (37) has a recess (45) that communicates continuously with the inflow conduit (44), the valve body (35) has a cylindrical spool part (46) which is spaced apart from the first valve sealing face (37) toward the valve chamber (27), and on a side remote from the first valve sealing face (37) carries the second valve sealing face (42) of the valve body (35), and the cylindrical spool part (46) together with the cylindrical wall of the valve chamber (27) has a throttle gap that forms the throttle (47), wherein the valve body (35) has a cylindrical collar (49) which is spaced apart from the first valve sealing face (37) toward the valve chamber (27) and together with the cylindrical wall of the valve chamber (27) forms an annular gap (50), wherein between the collar (49) and the cylindrical spool part (46) an annular chamber (51)

is formed, from which the pressure conduit (26) branches to connect to the control chamber (25).

2. The fuel injection system of claim 1, in which the outflow conduit (39) leads out, coaxially to the axis of the cylindrical spool part (46), from the second valve seat (41), and in the outflow conduit (39), a compensation spool (54) adjoining the cylindrical spool part (46) is adjustable together with the control valve member.

* * * * *

UNITED STATES PATENT AND TRADEMARK OFFICE

CERTIFICATE OF CORRECTION

PATENT NO. : 6,390,066 B1
DATED : May 21, 2002
INVENTOR(S) : Eugen Drummer et al.

It is certified that error appears in the above-identified patent and that said Letters Patent is hereby corrected as shown below:

Title page,
Item [86], should read as follows:

-- [86] PCT No. : PCT/DE 99/03783
371 Date: November 3, 2000
102(e) Date: November 3, 2000 --

Signed and Sealed this

Sixteenth Day of July, 2002

*Attest:*

*Attesting Officer*

JAMES E. ROGAN
*Director of the United States Patent and Trademark Office*